US010772789B2

(12) United States Patent
Abdo

(10) Patent No.: US 10,772,789 B2
(45) Date of Patent: Sep. 15, 2020

(54) MASSAGE DEVICE

(71) Applicant: John S. Abdo, Marina Del Rey, CA (US)

(72) Inventor: John S. Abdo, Marina Del Rey, CA (US)

( * ) Notice: Subject to any disclaimer, the term of this patent is extended or adjusted under 35 U.S.C. 154(b) by 734 days.

(21) Appl. No.: 14/775,201

(22) PCT Filed: Mar. 11, 2014

(86) PCT No.: PCT/US2014/023529
§ 371 (c)(1),
(2) Date: Sep. 11, 2015

(87) PCT Pub. No.: WO2014/164808
PCT Pub. Date: Oct. 9, 2014

(65) Prior Publication Data

US 2016/0022529 A1 Jan. 28, 2016

Related U.S. Application Data

(60) Provisional application No. 61/880,574, filed on Sep. 20, 2013, provisional application No. 61/776,419, filed on Mar. 11, 2013.

(51) Int. Cl.

| | |
|---|---|
| ***A61H 7/00*** | (2006.01) |
| ***A61H 15/00*** | (2006.01) |
| ***A61H 39/04*** | (2006.01) |

(52) U.S. Cl.
CPC ..... *A61H 7/003* (2013.01); *A61H 7/007* (2013.01); *A61H 15/00* (2013.01);
(Continued)

(58) Field of Classification Search
CPC .... A61H 7/003; A61H 39/04; A61H 15/0092; A61H 7/007; A61H 15/00;
(Continued)

(56) References Cited

U.S. PATENT DOCUMENTS 5,772,614 A 6/1998 Lindquist
5,941,806 A * 8/1999 Olschansky ..... A63B 23/0222 482/132
(Continued)

FOREIGN PATENT DOCUMENTS

CN 2188313 Y 2/1995
CN 2746938 Y 12/2005
(Continued)

OTHER PUBLICATIONS

Chinese Office Action dated Oct. 9, 2017 for corresponding Chinese Application No. 201480025590.1, filed Nov. 5, 2015.
(Continued)

*Primary Examiner* — Quang D Thanh
(74) *Attorney, Agent, or Firm* — Albert Bordas, P.A.

(57) ABSTRACT

A massage device includes spaced apart first and second arms having aligned first and second pivot areas. A cross bar having a first end and a second end is attached to the first arm proximate the first end of the cross bar between the first and second pivot areas. The cross bar is attached to the second arm proximate the second end of the cross bar between the first and second pivot areas. A massage element is carried by the cross bar.

7 Claims, 14 Drawing Sheets

(52) U.S. Cl.
CPC ..... *A61H 15/0092* (2013.01); *A61H 39/04* (2013.01); *A61H 2015/0014* (2013.01); *A61H 2201/1253* (2013.01); *A61H 2201/1284* (2013.01); *A61H 2201/1609* (2013.01); *A61H 2201/1623* (2013.01); *A61H 2201/1664* (2013.01); *A61H 2201/1676* (2013.01); *A61H 2201/1685* (2013.01); *A61H 2201/1695* (2013.01); *A61H 2205/04* (2013.01); *A61H 2205/062* (2013.01); *A61H 2205/081* (2013.01)

(58) Field of Classification Search
CPC .... A61H 2201/1609; A61H 2201/1664; A61H 2201/1623; A61H 2205/081; A61H 2201/1284; A61H 2201/1253; A61H 2015/0014; A61H 2205/04; A61H 2201/1685; A61H 2201/1676; A61H 2205/062
See application file for complete search history.

(56) References Cited

U.S. PATENT DOCUMENTS 6,220,995 B1 * 4/2001 Chen ..... A63B 21/02 297/175
6,419,650 B1 * 7/2002 Ryan ..... A61H 15/00 601/122
6,592,500 B1 * 7/2003 McBride ..... A63B 21/0004 482/140
2004/0242389 A1 12/2004 Kerry
2004/0249325 A1 12/2004 Stultz
2005/0079957 A1 4/2005 Bowman et al.
2006/0068979 A1 3/2006 Hsieh
2009/0197741 A1 8/2009 Poillucci et al.
2013/0029812 A1 * 1/2013 Teeter ..... A61H 1/0292 482/126

FOREIGN PATENT DOCUMENTS

CN 201894807 U 7/2011
CN 202095868 U 1/2012

OTHER PUBLICATIONS

Chinese Office Action dated Nov. 16, 2016 for corresponding Chinese Application No. 201480025590.1, filed Nov. 5, 2015.
International Search Report and Written Opinion dated Aug. 14, 2014, for corresponding International Application No. PCT/US2014/023529, filed Mar. 11, 2014.
Chinese Rejection Decision dated Apr. 20, 2018 for corresponding Chinese Application No. 20140025590.1, filed Nov. 5, 2015.

* cited by examiner

MASSAGE DEVICE

CROSS-REFERENCE TO RELATED APPLICATION(S)

This Application is a 371 National Stage Application of International Application No. PCT/US2014/023529, filed on Mar. 11, 2014, published as International Publication No. WO 2014/164808 A1, which claims priority to U.S. Provisional Patent Application No. 61/776,419, filed on Mar. 11, 2013, and U.S. Provisional Patent Application No. 61/880,574, filed on Sep. 20, 2013, the contents of which are incorporated by reference in their entireties.

BACKGROUND

The discussion below is merely provided for general background information and is not intended to be used as an aid in determining the scope of the claimed subject matter.

The present disclosure relates to a manually operated massage device. More particularly, the present disclosure relates to a manually operated massage device that is capable of providing massage therapy to the neck region, mid-to-upper back region, and lower back region of an individual.

Many people have muscular issues in the one or more of the thoracic, cervical and/or lumbar regions of their backs. For many people a therapeutic massage is recommended to relieve muscular pain issues, decrease muscle and joint stress, assist in decompression, and/or to increase the flexibility and posture of the back and spine. The massage relaxes the muscles and relieves muscular tension, which can cause discomfort, pain and can cause impingement of a nerve extending through the spinal column.

However, due to the location of the spinal column relative to a person's arms, a person typically cannot massage the muscles of their own back. Therefore, people are typically required to visit a massage therapist to receive a back massage. However, many people are not willing to take the time required to visit a massage therapist. Further, many people are not financially able to visit a massage therapist.

There is a need for a device that a person could utilize to massage the muscles around the spine and on the back of the person. However, most people do not want large machines in their homes. Therefore, the device would need to be compact, convenient and easy to use, and also easy to assemble and disassemble.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

One aspect of the present disclosure relates to a massage device that can be utilized to massage a person's back, including the thoracic, cervical and lumbar regions. The device includes left and right arms that are substantially similar in configuration where both the left and right arms have a middle portion. A cross bar can be removably attached to the middle portions of the left and right arms, and when attached, the cross bar spaces the left and right arms apart. Both the left and right arms include a front raised angled portioned extending from a front end of the middle portion and a back angled portion extending from a back end of the middle portion. Each arm includes a front pivot area at the junction of the front end of the middle portion and front angled portion and a back pivot area at the junction of the back end of the middle portion and the back angled portion. The cross bar carries a massage element where the massage elemnt is configured to provide a massaging action to the selected muscles as the left and right arms are pivoted either on the front pivot area or the back pivot area.

Another aspect of the present disclosure relates to the front pivot areas and the back pivot areas being aligned on the left and right arms.

Another aspect of the disclosure relates to the first arm and the second arm have the same configuration. A length of the first back angled portion is larger than a length of the first front angled portion and the second back angled portion is larger than the length of the second front angled portion.

Another aspect of the present disclosure relates to an overlay being positioned on the back angled portions.

Another aspect of the present disclosure relates to the massage element being a roller with a first edge and a second edge and a recessed channel positioned between the first and the second edges of the roller.

Another aspect of the present disclosure relates to a cover that is removably secured to the roller. The cover can include a plurality of knobs and/or probes.

Another aspect of the present disclosure relates to the massage element comprises a pad.

Another aspect of the present disclosure relates to the arching pad having a rectangular configuration.

Another aspect of the present disclosure relates to the arching pad having a convex upper surface and a concave lower surface.

Another aspect of the present disclosure relates to a massage device having spaced apart first and second arms both arms having aligned first and second pivot areas. A cross bar having a first end and a second end wherein the cross bar is attached to the first arm proximate the first end of the cross bar between the first and second pivot areas and wherein the cross bar is attached to the second arm proximate the second end of the cross bar between the first and second pivot areas. A massage element is carried by the cross bar.

Another aspect of the present disclosure relates to the first and second arms each comprise a middle portion having a first end and a second end and a front angled portion extends from the first end of the middle portion wherein a junction of the front angled portion and the first end of the middle portion forms the first pivot area. A back angled portion extending from the second end of the middle portion wherein a junction of the second end of the middle portion and the back angled portion forms the second pivot area.

While the aspects are disclosed separately, it is contemplated that aspects separately can be combined with other aspects in any combination desired.

DETAILED DESCRIPTION OF ILLUSTRATIVE EMBODIMENTS

Figure 1:
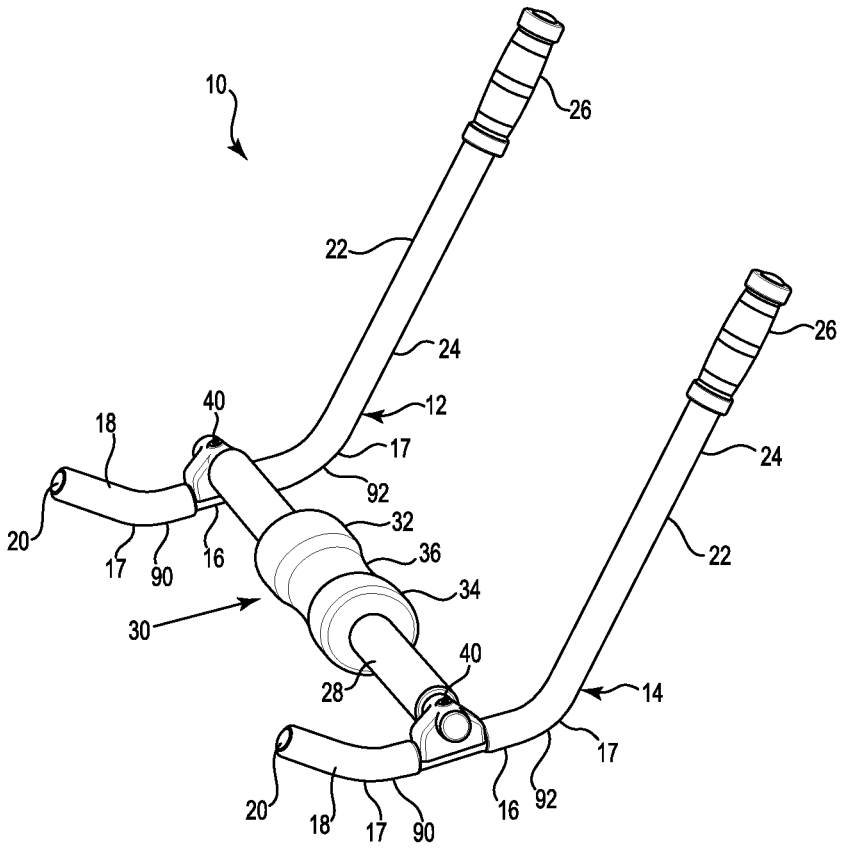
FIG. 1 is a perspective view of a massage device.
Figure 2:
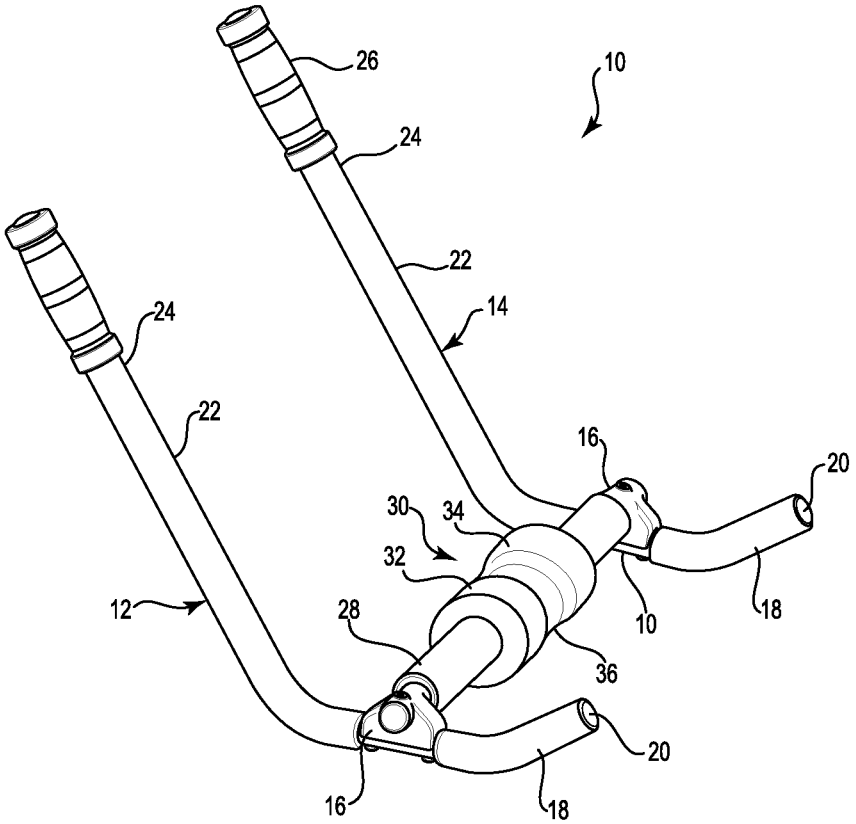
FIG. 2 is a front view of the massage device.
Figure 3:
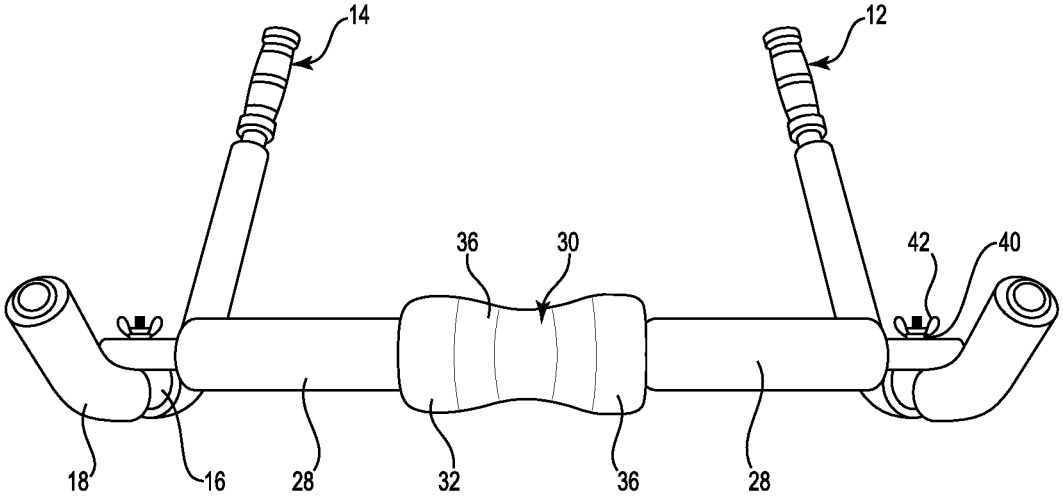
FIG. 3 is another perspective view of the massage device.
Figure 4A:
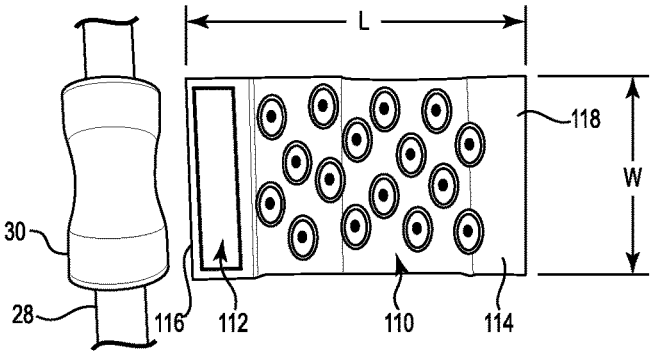
FIG. 4A is a top view of a cross bar with a roller and an acupressure wrap.
Figure 4C:
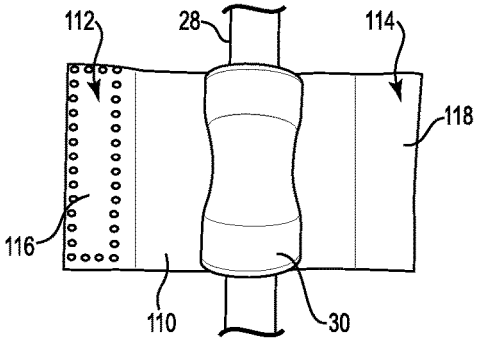
FIG. 4C is a top view of the cross bar with an acupressure wrap positioned underneath the roller.
Figure 4B:
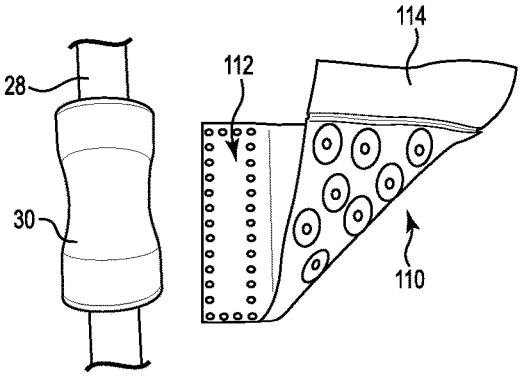
FIG. 4B is a top view of the cross bar with the roller and the acupressure wrap in a twisted configuration.
Figure 4D:
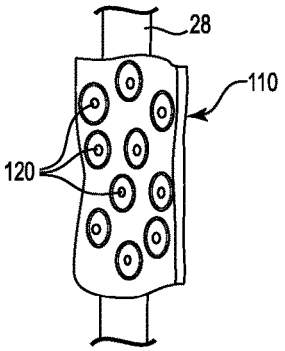
FIG. 4D is a top view of the acupressure wrap secured around the roller.

A massage device is generally illustrated at 10 in FIG. 1. The massage device 10 includes spaced apart left and right arms 12 and 14 that are secured together with a cross bar 28 that typically carries a massage roller or a massage pad. The left and right arms 12 and 14 are similarly constructed and are interchangeable with each other. Manual force is placed upon the left and right arms 12 and 14 to move the massage roller or the massage pad upward and/or downward, in an arcing motion, to provide a massage to a selected area on a person's body.

Figure 12:
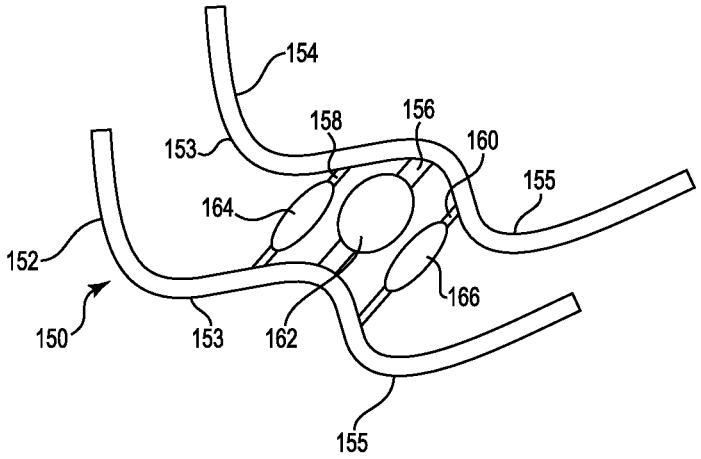
FIG. 12 is a schematic view of the massage device with a plurality of cross bars and massage pads.

Referring to FIGS. 1-4, each arm 12 and 14 includes a middle portion 16. A typical configuration of the middle portion includes a substantially straight configuration along a longitudinal axis such that a bottom surface of the middle portion is configured to engage a surface, such as a floor, along the length of the middle portion 16. However other configurations of the middle portion 16 are also contemplated, including but not limited to a vertically arcuate configuration as illustrated in FIG. 12.

Referring back to FIGS. 1-4, each arm 12 and 14 also includes a front portion 18 having a proximal end attached to a front end of the middle portion 16 with a front pivot portion 90. The front portion 18 is angled upwardly from the middle portion 16 and forms a first interior obtuse angle. An end cap 20 is secured to a distal end of the front portion 18 where the end cap 20 provides a smooth surface and provides protection to the user when moving or utilizing the device 10

The back portion 22 extents outwardly from the middle portion 16 and forms a second interior obtuse angle similar to the first angle of the front portion 18 with the middle portion 16. The front end of the back portion 22 is joined to the back end of the middle portion 16 with a back pivot portion 92.

As illustrated, the back portion 22 is about three times longer than the front portion 18. However other ratios of the lengths the front portion 18 to the back portion 22 are also contemplated including, but not limited to, a range from a 1 to 1 ratio to a 5 to 1 ratio.

The left and right arms 12 and 14 that are typically formed from a single piece of tubular material, such as a metal, typically steel. However, other materials of construction are also contemplated. It is also contemplated that the left and right arms 12 and 14 can be constructed using components that are secured together.

A rubberized overlay 24 is positioned over a distal end of the back portion 22 where the rubberized overlay 24 extends down a length of the back portion 22. The rubberized overlay 24 provides a gripping surface for a person to grip the left and/or right arms when using the device as well as when assembling and disassembling the device 10. The rubber overlay 24 includes a plurality of grooves 26 that increase the ability of a person to grip the rubberized overlay 24. However, the overlay 24 is not necessary and also may have different configurations than depicted in FIG. 1.

The cross bar 28 is removable attach proximate a midpoint of the middle portion 16 along both the left and right arms 12 and 14, respectively. The cross bar 28 is typically attached to the middle portions 16 of the left and right arms 12 and 14 utilizing bolts 40 that are inserted through apertures in the middle portion 16 that align with the apertures 29 approximate the ends of the cross bar 28.

The bolt 40 can threadably engage a surface defining a through bore in the middle portion 16. Alternatively, nuts 42 can threadably engage the bolts 40 to secure the cross bar 28 to the left and right arms 12 and 14. It is also contemplated that other securing mechanisms can be utilized including, but not limited a camming mechanism, a clamp and a spring loaded pin.

It is also contemplated that the cross bar 28 be permanently attached to the left and right arms. The cross bar 28 can be permanently with attached with an attaching mechanism such as, but not limited to a weld, a rivet, bonding with an epoxy, glue or other adhesive.

The cross bar 28 includes at least one massaging element such as a roller 30, where one configuration of the roller 30 includes left and right protuberances 32 and 34 proximate the edge of the roller 30 and a recessed groove 36 between the protuberances 32 and 34. The massaging roller 30 with the single recessed groove 36 is illustrated in FIGS. 1-4A-D, where the protuberances 32 and 34 are configured to be positioned on opposite sides of the spinal column and the recessed groove 36 accepts the spinal column. However, other configurations of the massaging element or roller 30 are also contemplated.

Referring to FIGS. 4A-4D, the roller 30 can optionally be covered with a removable cover 110. The removable cover 110 has a length L and a width W that are sufficient to cover the roller 30. The removable cover 110 typically includes mating strips 112 and 114 of a hook and look securing mechanism, such as that provided under the VELCRO® trademark. The strips 112 and 114 are typically secured proximate opposite edges 116 and 118 along the width of the cover 110. While a hook and loop closure mechanism is disclosed, other closure mechanisms are also contemplated including a drawstring, zipper, snaps and buttons and loops and/or buttonholes.

The cover 110 can optionally include a plurality of knobs and/or probes 120 that are affixed along various locations in the cover 110. The plurality of knobs and/or probes 120 protrude from the cover 110 and have a rigidity that is greater than that of the cover 110. The plurality of knobs or probes 120 knead into the body's tissues to provide a deeper and more penetrating massage to a selected area.

The kneading of the body's tissues with the knobs and/or probes 120 is referred to as acupressure. The benefits of the acupres sure roller cover 110 include muscle and nerve stimulation, increased tissue flexibility, assisting in relieving muscle stiffness, soreness and spasms, increased blood flow, and enhanced strength and energy to the selected muscles.

The plurality of knobs and/or probes 120 can be of any size, shape and/or quantity. The plurality of knobs and/or probes 120 can be of any configuration including, but not limited to, pointed, a partial sphere, a cube or any other geometric configuration.

Because the cover 110 increases the diameter of the roller 30, the area that the can be massaged can be increased relative to an uncovered roller 30 while activating the arms 12 and 14 with manual force. However, it is also contemplated that the cover 110 can also be utilized by laying on top of the roller 30 without moving the roller 30. Besides being used to massage/knead the back tissues, the roller 30 with the cover 110 can be used to massage/knead other areas of the body.

Figure 5:
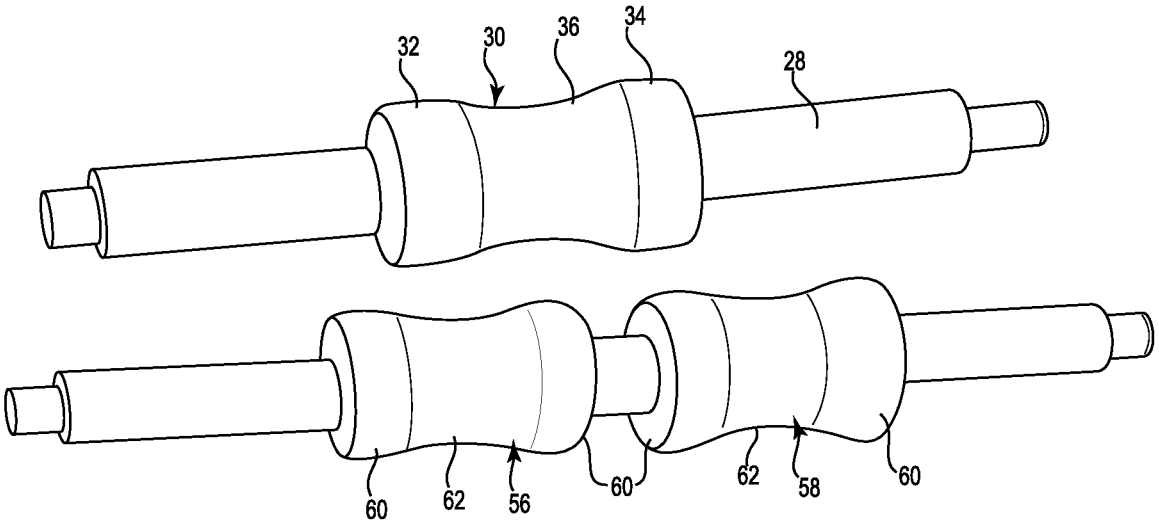
FIG. 5 is a view of cross bars having differently configured massage rollers.

Referring to FIG. 5, an alternative roller is also illustrated where dual rollers 56 and 58 can be utilized. The rollers 56 and 58 include raised edges 60 and an indention 62 such that four pressure points can be massaged at once on a person's body. The rollers 56 and 58 can be utilized in a synchronized fashion where the rollers 56 and 58 move in the same direction as the arms 12 and 14 are activated.

It is also contemplated that that the cross bar 28 include mechanism located between the roller 56 and the roller 58 that can be positioned into an unlocked position where the roller 56 can be activated and moved independently of the roller 58 and vice versa to a locked position where the rollers 56 and 58 are moved in a synchronized movement. One mechanism that is contemplated is a swivel. However other mechanisms are also contemplated.

When in the locked position, the mechanism allows for simultaneous or synchronized movement of the rollers 56 and 58 in the same direction. When in the unlocked position, the mechanism allows the independent activation of the rollers 56 and 58 where one roller can be static and the other roller is moved. Similarly one roller 56 can be moved in the forward direction by pushing an arm in the forward direction while the other roller is moved in the rearward direction by pushing the other arm in the opposite direction. As such, a "push and pull" alternating movement can be created with the rollers 56 and 58 when the mechanism is in the unlocked position. It is also contemplated that the rollers 56 and 58 can optionally be covered with an individual cover similar to the cover 110.

Figure 6:
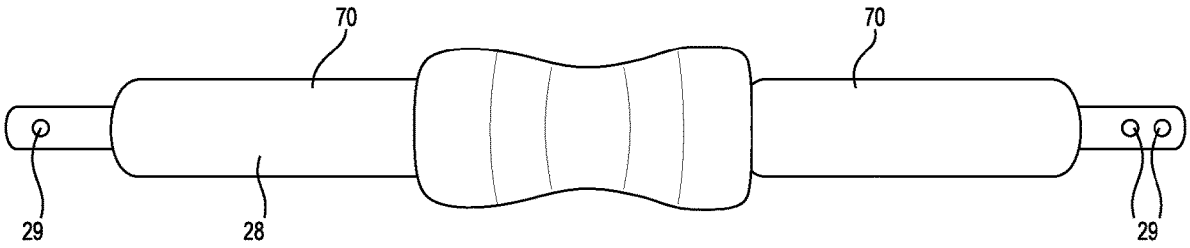
FIG. 6 is top view of a cross bar having a single massage roller.

Referring to FIG. 6, the cross bar 28 is illustrated with apertures 29 at the distal ends. However, as illustrated at FIG. 6, the cross bar 28 can include a plurality of apertures 29 such that the effective length of the cross bar 28 can be adjusted relative to the left and right arms 12 and 14. While only one set of apertures 29 is shown at the right end of the cross bar 28, it is contemplated that the left end could also include a series of apertures 29 such that a width of the device from the left arm 12 to the right arm 14 can be adjusted to a desired width of the person's body.

The cross bar 28 can also optionally include a foam padding 70 that can be positioned on both sides of the massage roller 30 or the pad 50. The foam padding 70 insures comfort to the person while having also providing a level of massage as a metal tube such as illustrated at 28 can be cold and clammy when touching a person's body.

Referring to FIG. 12, an alternative massage device 150 is illustrated. The device 150 includes left and right arms 152 and 154 and a plurality of cross bars 156, 158 and 160. Each cross bar 156, 158 and 160 has a massaging roller 162, 164 and 166, respectively. The rollers 162, 164 and 166 can have a configuration such as that of the roller 30 or the rollers 56 and 58 or an arch pad that is discussed later in the application. The rollers 162, 164 and 166 can be utilized individually or in any combination thereof to provide the desired massaging of the selected area. By positioning rollers on either side of the mid point between two pivot points 153 and 155 on the arms 152 and 154, the rollers 162, 164 and 166 can be moved on an eccentric meaning the pads moves further when moved on one pivot relative to the other pivot, and thereby provides a more tailored massage to a selected area.

Figure 7:
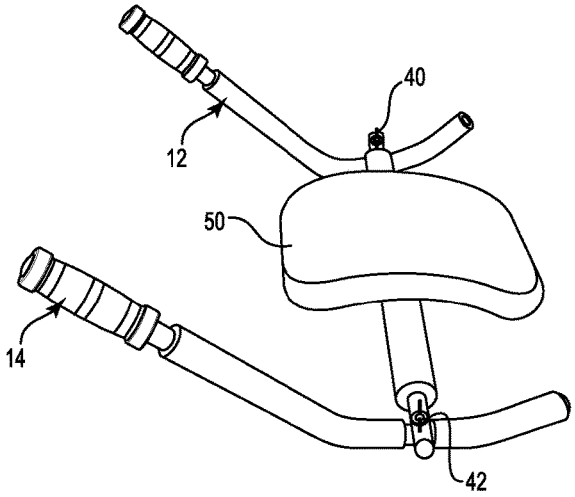
FIG. 7 is a perspective view of the massage device with an arch pad.
Figure 8:
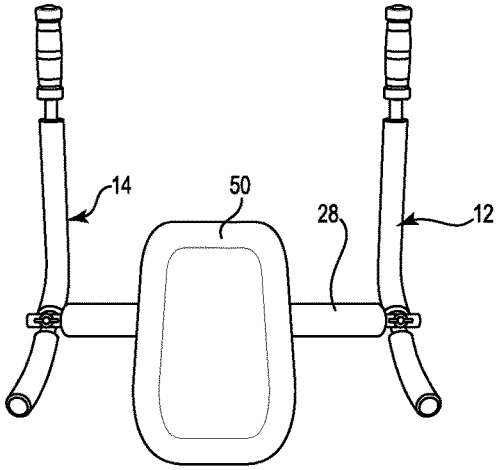
FIG. 8 is another perspective view of the massage device with the arch pad.
Figure 8A:
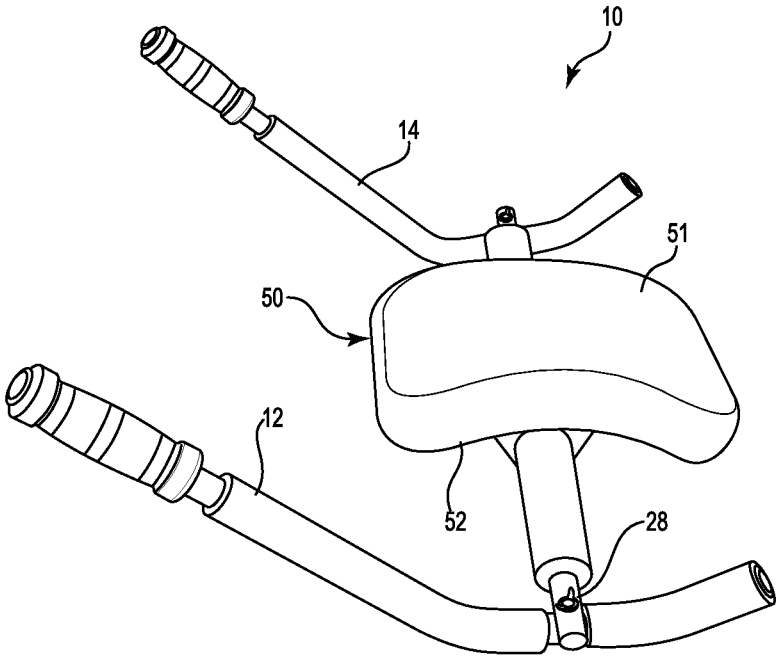
FIG. 8A is a perspective view of the massage device with an independent arch pad placed over the roller.
Figure 8B:
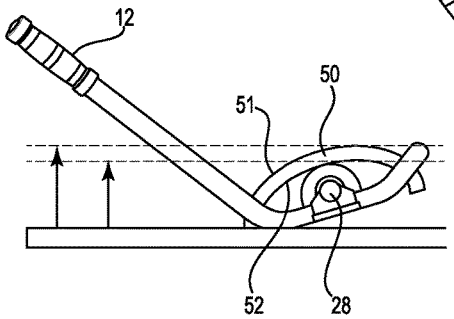
FIG. 8B is a side view of the massage device with the arch pad paced over the roller pivoted on a back pivot portion.
Figure 8C:
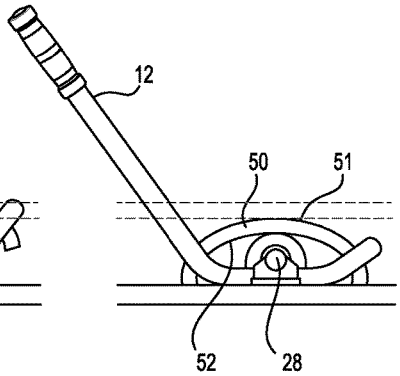
FIG. 8C is a side view of the massage device with the arch pad paced over the roller in a resting position.
Figure 8D:
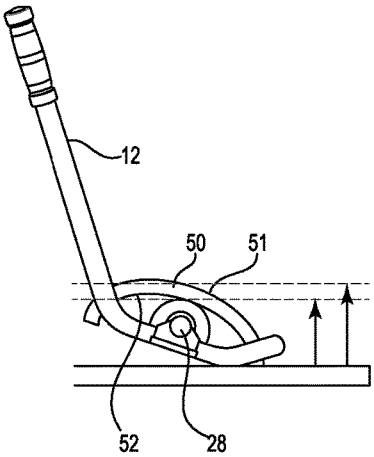
FIG. 8D is a side view of the massage device with the arch pad paced over the roller pivoted on a front pivot portion.
Figure 8E:
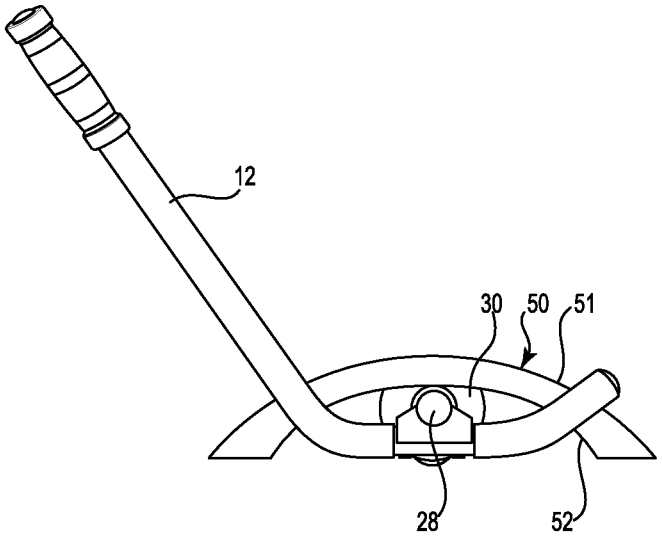
FIG. 8E is a side view of the massage device in a resting position with the arch pad placed over the roller.

Referring to FIGS. 7-8E, other massaging pads are also illustrated including a arch pad 50 where the arch pad 50 can be secured over the roller 30, as illustrated in FIGS. 8A-8E, the rollers 56 and 58 or secured to a cross bar 28 by itself, as illustrated in FIGS. 7 and 8. The arch pad 50 can be utilized in a similar fashion as the device with the roller 30 where the arms 12 and 14 are activated to pivot and raise the arch pad 50 a selected distance, typically between about three and four inches from the ground level which corresponds to about an 18 degree angle between mid portion and the ground level when in a pivoting position.

Alternatively the arch pad 50 can be used as a stand-alone arch pad apart from the massage device 10. The arch pad 50 includes a convex upper surface 51 and a concave lower surface 49. The arch pad 50 is configured to engage the back and especially the lower back or the lumbar region.

The arch pad 50 is intended to stretch and decompress the spinal vertebrae and elongate the back muscles and thereby provide relief from back pain and improve flexibility. The arch pad 50 covers a greater region of the back relative to the utilizing only the roller 30 attached to the cross bar 28. When positioned over the roller 30, the arch pad 50 can be used 'statically' as the person lays on top of it motionless, or 'dynamically' as the person activates the arms 12 and 14 to set the arch pad 50, and underlying roller 30, in motion. The arch pad 50 can be utilized to massage larger portions of the person's back and/or neck depending on the person's preference.

The arch pad 50 typically has a width of about 8 inches and a nominal length of about 12 inches. However other dimensions are also contemplated.

Figure 9A:
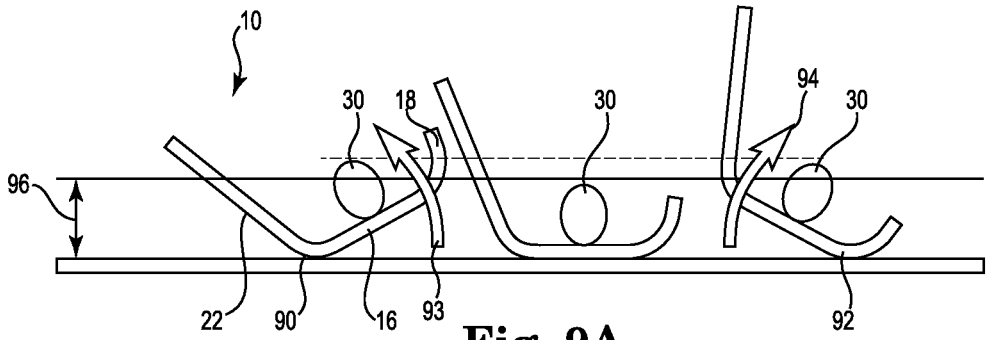
FIG. 9A is a series view of the pivoting motion of the device.
Figure 9B:
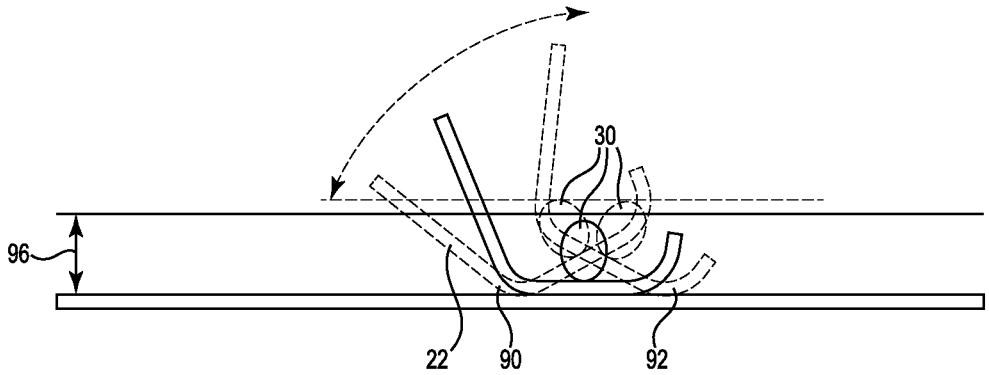
FIG. 9B is a schematic view of the pivoting motion of the device.

The use of the device 10 having the left and right arms with the middle portion 16 along with the front portion 18 and the back portion 22 is schematically illustrated at FIGS. 9A and 9B. Referring to FIG. 9A, a side view of the device is illustrated in use, where the middle portion 16 of the device is flat on the ground and would be considered in a rest position. When the person grips the back portion 22 and pulls the back portion towards the person's body as indicated by arrow 93, the device 10 moves on a pivot area 90 such that the roller 30 is raised and rotates in a slight arcuate direction on the cross bar 28 and therefore provides a deeper, more penetrating, wider massage on the person's back. Alternatively, if the person applies a force in the direction of the arrow 94, the roller 30 is raised on the pivot area 92 in the opposite direction and therefore another region of a person's back is being massaged. The same action would occur using the device 10 with the pad 50.

The distance of vertical movement of the roller 30 is indicated at arrow 96. As illustrated the amount of vertical movement ranges from between about 3 to 4 inches. However, other distances of vertical movement are also contemplated where the amount of vertical movement could be affected by increasing or decreasing the distance between of the pivot portions 90 and 92, or moving the roller 30 or pad 50 closer to one of the pivot areas 90 or 92, such at an eccentric motion is formed and one pivot area 90 or 92 will raise the roller more than the other pivot area 90 or 92, or the dimensions of the device 10 including the arms 12 and 14, the cross bar 28, the roller 30 and/or the pad 50 are increased.

The movement of the roller 30 is illustrated in FIG. 9B and illustrates a movement from a relaxed state to where the device is pivoted on the pivot area 90 and on the pivot area 92. The same motion would occur with the pad 50 attached to the cross bar 28.

Referring back to FIG. 1, the bottom surfaces of the arms 12 and 14 can optionally include anti-slipping pads 17 located at the pivot areas 90 and 92 and below the connection to the cross bar 28. The anti-slip pads 17 minimize the movement of the device 10 across the floor and stabilize the device 10 when utilized to massage the back that can be caused by to the back and forth rocking motion.

Figure 10A:
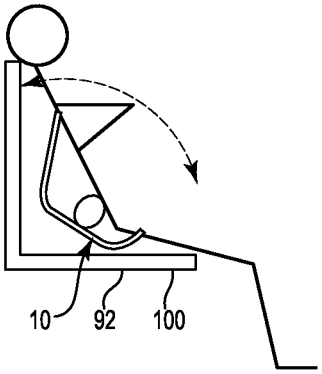
FIG. 10A is a schematic view of a use of the device from a seated position for massaging the lumbar region of a person's back.
Figure 10C:
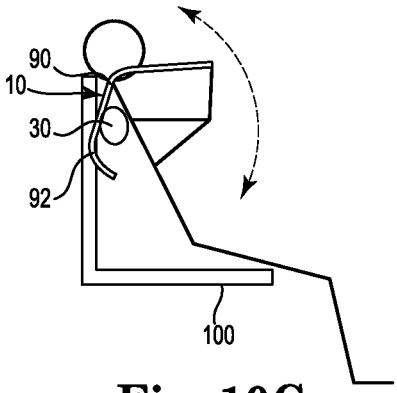
FIG. 10C is a schematic view of a use of the device from a seated position for massaging the thoracic or cervical region of a person's back.
Figure 10E:
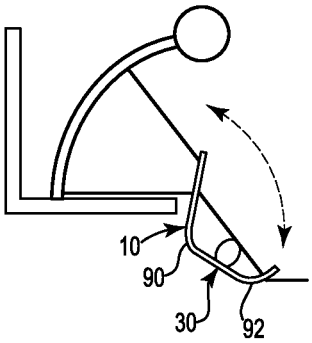
FIG. 10E is a schematic view of a use of the device from a seated position for massaging as the lower leg, calves and Achilles tendons.
Figure 10B:
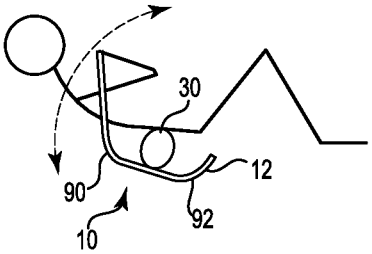
FIG. 10B is a schematic view of a use of the device from a prone position for massaging the lumbar region of a person's back.

Referring to FIGS. 10A-10E, the device is illustrated being used in numerous positions. Referring to FIG. 10A, the device 10 illustrated with a person seated in a chair 100 and where the device 10 is being pivoted on the pivot area 92 to massage the muscles of the lumbar region of a person's back. Referring to FIG. 10B, the device 10 is being shown utilized on the lumbar region of a person's back in a prone position. In this position the roller 30 can be manipulated on the pivot areas 90 and 92 to massage the persons back.

Figure 10D:
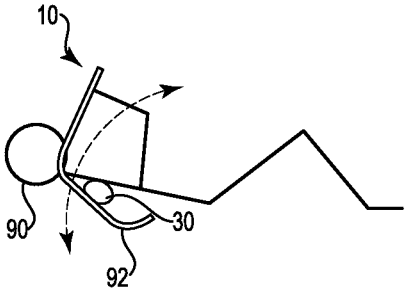
FIG. 10D is a schematic view of a use of the device from a prone position for massaging the thoracic or cervical region of a person's back.

Referring to FIG. 10C, the device 10 is shown illustrated with a person seated in a chair 100 and massaging the thoracic or cervical region of the back, where the roller 30 engages the upper regions of the back. The device can be pivoted on the pivot areas 90 and 92 to provide the desired range of motion. Referring to FIG. 10D, the device is shown being utilized with a person in a prone position, where the person is massaging the cervical and thoracic regions of the back, where both the pivot 92 and 90 can utilized to effectuate movement of the roller 30 along the persons back.

Referring to FIG. 10E, the device 10 can be utilized for numerous other purposes besides massaging the persons back including massaging the person' lower legs, calves and/or Achilles tendons utilizing the roller 30 by moving the device on the pivot areas 92 and 90, while seated in a chair or alternatively sitting on the floor.

Figure 11A:
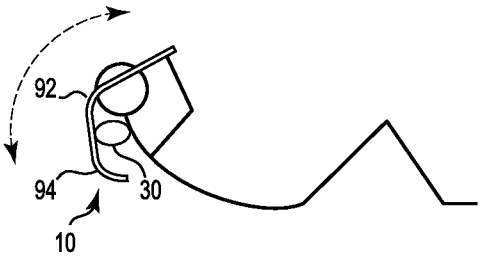
FIG. 11A is another schematic view of a use of the device for muscle-toning exercises such as abdominal crunches.

Referring to FIG. 11A, the device 10 can be utilized when a person is conducting an abdominal crunch or sit-up. The device 10 can be utilized with the roller 30 to either support or massage the users neck or head region while the hands secure the arm bars for support and technical guidance while conducting abdominal exercises.

Figure 11B:
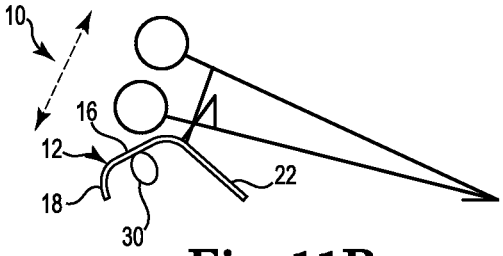
FIG. 11B is another schematic view of a use of the device for muscle-toning exercises such as such as pushups.
Figure 11C:
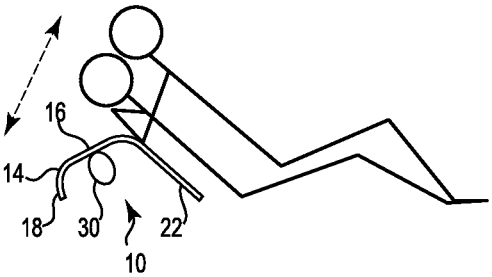
FIG. 11C is another schematic view of a use of the device for muscle-toning exercises such as reverse dips.

Referring to FIG. 11B, because the arms 12 and 14 have the raised portions 18 and 22, when the ends of the arms 18 and 22 are positioned on the floor, the middle portion 16 and the cross bar 28 is raised. Because middle portion 16 the cross bar 28 is raised, a person can exercise using the arms 18 and 22 or utilizing the raised portion to do a push up which exercises the arms, chest, shoulder and back muscles. Alternatively, referring to FIG. 11C, a person can utilize the device 10 to exercise the arms, chest, shoulder and back muscles from a different angle by doing arm dips due to the fact that the arms 12 and 14 have raised portions relative to the floor surface as well as the cross bar 28 elevated above the floor surface.

While many exercises have been depicted it is also conceivable to use the device 10 for other exercises that are not illustrated herein.

Although the present invention has been described with reference to preferred embodiments, workers skilled in the art will recognize that changes may be made in form and detail without departing from the spirit and scope of the invention.

What is claimed is:

1. A massage device comprising:

A) first and second arms, each of said first and second arms has a front portion, a back portion, a straight middle portion, a first pivot area, and a second pivot area, each said front portion has a proximal end and a distal end, each said straight middle portion has a front end and a back end, each said first pivot area is defined by a first connection between a respective said proximal end with a respective said front end, and each said second pivot area is defined by a second connection between a respective said back end with a respective said back portion, each said first pivot area is separated from its respective said second pivot area by its respective said straight middle portion, each said straight middle portion has a straight configuration along a respective longitudinal axis such that a bottom surface of each said straight middle portion is configured to engage a surface along a length of each said straight middle portion, said first and second arms pivot with said surface at each respective said first pivot area when said massage device moves in a first direction, and said first and second arms pivot with said surface at each respective said second pivot area when said massage device moves in a second direction, wherein said second direction is opposite to said first direction;

B) a cross bar having first and second ends that are attached to said first and second arms respectively at each said straight middle portion, said cross bar keeps said first and second arms at a spaced apart relationship with respect to each other, said first and second ends are removably attached to said first and second arms respectively of each said straight middle portion, said first and second ends are removably attached utilizing bolts that are inserted through first apertures at a midpoint of each said straight middle portion that align with second apertures at said first and second ends;

C) at least one roller being mounted to said cross bar, said at least one roller comprising first and second protuberances disposed adjacent to first and second edges, and a recessed groove disposed between said first and second protuberances; and D) an arch pad configured to be secured over said at least one roller, said arch pad having a convex upper surface and a concave lower surface, wherein said arch pad is mounted over said at least one roller.

2. The massage device set forth in claim 1, further comprising a removable cover having cooperative and sufficient dimensions to completely cover each said at least one roller, said removable cover comprising opposite edges along a width of said removable cover, said removable cover further comprising a plurality of knobs or probes disposed and protruding from said removable cover, said plurality of knobs or probes having a first rigidity that is greater than a second rigidity of said removable cover.

3. The massage device set forth in claim 2, wherein said removable cover further comprises first and second locking mating strips mounted to respective said opposite edges, said locking mating strips are a hook and loop closure mechanism, a drawstring, a zipper, snaps and buttons, or loops and buttonholes.

4. The massage device set forth in claim 1, wherein said first and second ends of said cross bar are removably attached to said first and second arms respectively at said midpoint of each said straight middle portion.

5. The massage device set forth in claim 1, wherein a length of each said back portion is larger than a length of each said front portion.

6. The massage device set forth in claim 1, wherein each said front portion is disposed at a first obtuse angle with respect to each respective said straight middle portion, and each said back portion is disposed at a second obtuse angle with respect to each respective said straight middle portion.

7. The massage device set forth in claim 1, wherein a first roller and a second roller of said at least one roller are mounted to said cross bar, said first roller being spaced apart from said second roller, said cross bar having a locking mechanism between said first roller and said second roller, in an unlocked position, said locking mechanism allows said first roller and said second roller to move independently, in a locked position, said locking mechanism allows said first roller and said second roller to move in a synchronized movement.

* * * * *